United States Patent [19]

Levkovski

[11] 3,960,092

[45] June 1, 1976

[54] COLLAPSIBLE STOOL

[75] Inventor: Nikola Levkovski, Forest Hills, N.Y.

[73] Assignee: Lawrence Peska Associates, Inc., New York, N.Y. ; a part interest

[22] Filed: Feb. 19, 1975

[21] Appl. No.: 551,035

[52] U.S. Cl. ..... 108/41; 108/128; 248/155.2; 248/434

[51] Int. Cl.[2] ..... A47B 3/00

[58] Field of Search ..... 108/41, 128; 248/155.2–155.5, 188.7, 432, 434, 435

[56] References Cited

UNITED STATES PATENTS

| | | | |
|---|---|---|---|
| 494,303 | 3/1893 | Nixon | 248/155.3 |
| 1,783,558 | 12/1930 | Brown | 108/41 |
| 2,358,865 | 9/1944 | McPherson | 248/188.7 UX |

FOREIGN PATENTS OR APPLICATIONS

| | | | |
|---|---|---|---|
| 419,129 | 12/1910 | France | 248/434 |

*Primary Examiner*—James C. Mitchell

[57] ABSTRACT

A collapsible stool comprising:

a. a tube having a first end and a second end;

b. a first cap detachably mounted to the first end of the tube;

c. a second cap detachably mounted to the second end of the tube;

d. a plurality of leg supports radially and detachably mounted to the second cap;

e. a plurality of support struts having first ends and second ends, extending radially from the tube and extending above the first end of the tube, detachably mounted at the first ends to the tube between the first end of the tube and the second end of the tube;

f. a plurality of mounting means attached to the tube between the first end of the tube and the second end of the tube for detachably mounting the first ends of the support struts to the tube;

g. a plurality of connecting struts pivotally connected to the second ends of the support struts wherein a plane surface is formed; and h. a seating surface attached to the plurality of connecting struts, wherein the tube has an inside diameter and a length of sufficient size to enclose the plurality of leg supports, support struts and connecting struts.

5 Claims, 5 Drawing Figures

FIG. 1
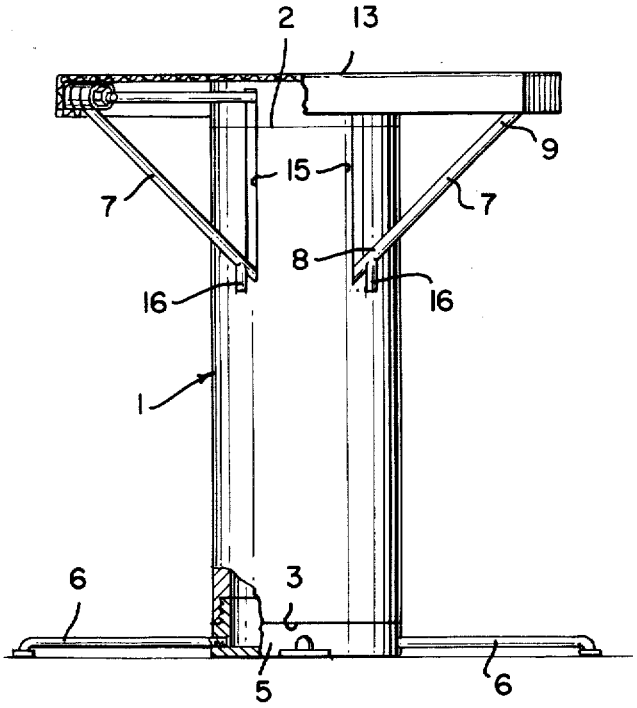
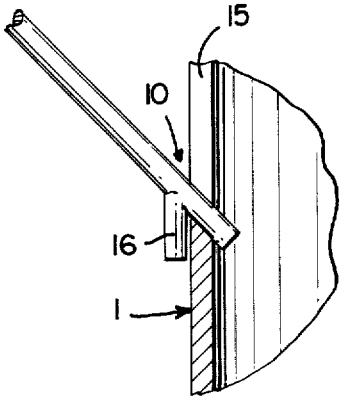
FIG. 4
FIG. 5
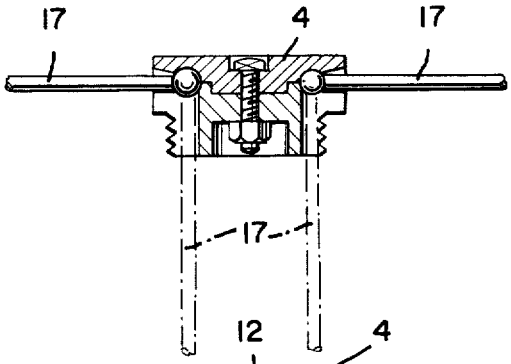
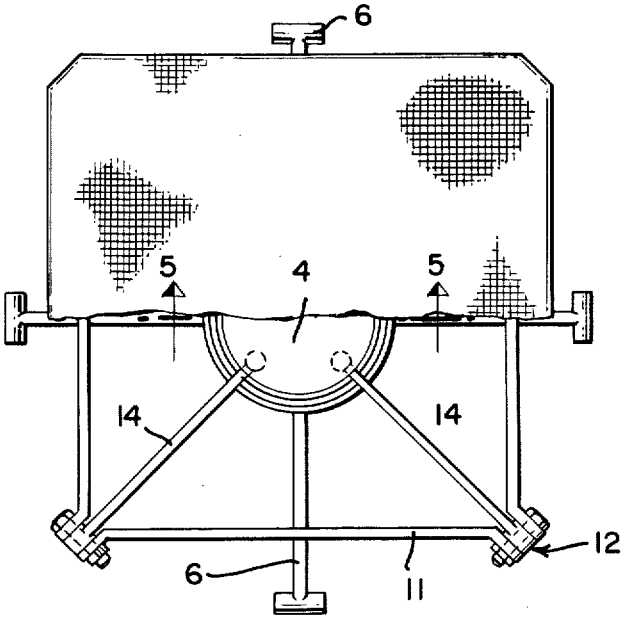
FIG. 3
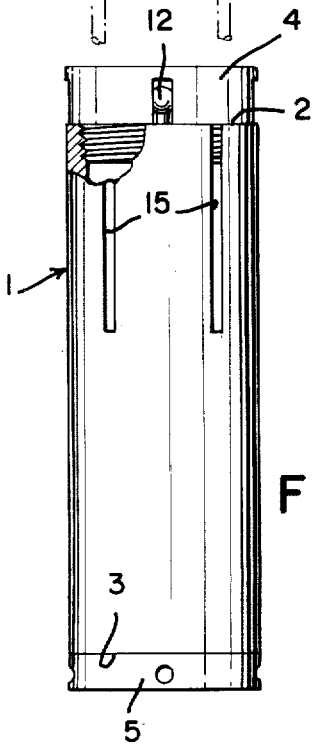
FIG. 2

COLLAPSIBLE STOOL

This invention relates to a collapsible stool comprising a tube having a first end and a second end with a cap detachably mounted at each end of the tube. There are a plurality of leg supports radially and detachably mounted to the second cap. A plurality of support struts having first ends and second ends extending radially from the tube and above the first end of the tube. The struts are detachably mounted to the tube between the first end and the second end of the tube. There are a plurality of mounting means attached to the tube between the first end of the tube and the second end of the tube for detachably mounting the support struts to the tube. The collapsible stool is further comprised of a plurality of connecting struts pivotally connected to the second ends of the support struts wherein a plane surface is formed for the placement of a seating surface. The tube is of such a diameter and such a length that it can enclose the plurality of leg supports, support struts and connecting struts when the collapsible stool is taken apart.

The object of the present invention is to provide a collapsible stool which is of simple and cheap construction.

Another object is to provide a collapsible stool device of the character set forth, having means whereby the device may be unfolded or spread to form a support for a seat and which folds compactly when not in use into a tube to facilitate transportation or storage thereof.

These objects and other objects are accomplished by means of the device disclosed in the drawings forming a part of the present application and in which:

FIG. 1 is an elevation, portions of which are longitudinal sections of the collapsible stool set up, or unfolded for use;

FIG. 2 is an elevation, portions of which are longitudinal sections of the folded stool as when not in use;

FIG. 3 is a top plan view;

FIG. 4 is a broken detailed view of a mounting means attached to the tube for detachably mounting the support struts to the tube; and FIG. 5 is a sectional view of the first cap and radial support struts taken along 5—5 of FIG. 3.

Referring to the drawings:

The numeral 1 is used to designate in general a tube, tubular body or housing having a first end 2 and a second end 3. This invention contemplates the use of any type material for construction of the tube, i.e., steel, plastic, wood, etc. This invention further contemplates the use of any type tube, i.e., square, rectangular and circular. It is preferred however due to ease of construction and strength that the tube be constructed of a steel and be a circular tube.

Attached to the first end of the tube is a cap 4. This cap is detachably mounted to the first end of the tube. It is preferred that when a circular tube is used that the cap be screwably mounted to the tube.

A second cap 5 is also detachably mounted to the second end of the tube. It is also preferred that when using a circular tube that this cap be screwably mounted to the tube.

A plurality of leg supports 6 are radially and detachably mounted to the second cap 5. It is preferred that these leg supports be of a thin tubular type member, optionally having support pads to insure stability of the collapsible stool. It is preferred that these leg supports be detachably mounted to the second cap by a screw means, i.e., screwably mounted to the second cap 5.

The collapsible stool is further comprised of a plurality of support struts 7 having first ends and second ends. The support struts extend radially from the tube and extend above the first end of the tube 1. The support struts 7 are detachably mounted at the first ends 8 to the tube 1 between the first end 2 of the tube 1 and the second end of the tube 3. It is contemplated by this invention that the support struts be constructed of any material and any shape which facilitates the use of the collapsible stool, i.e., circular, rectangular, square, etc.

A plurality of mounting means 10 are attached to the tube 1 between the first end of the tube 2 and the second end of the tube 3 for detachably mounting the first ends 8 of the support struts 7 of the tube 1. These detachable mounting means may be of any nature which will facilitate the use of the collapsible stool.

FIG. 4 demonstrates the use of one type mounting means which is comprised of slots 15 in the tube and a catch means 16 attached to the first end 8 of the support struts 7 for attaching the support struts 7 to the slots 15. The mounting means however may be of a screw type, a fitted orifice, etc.

A plurality of connecting struts 11 are pivotally connected at 12 to the second ends 9 of the support struts 7 wherein a plane surface 13 is formed by the struts.

Again this invention contemplates the use of any shape struts which will facilitate the use of the collapsible stool. The connecting struts are pivotally connected to the support struts to allow the support struts to be disconnected from the tube and have the support struts and the connecting struts folded into a long bundle of members, i.e., circular tubes, etc. This invention contemplates the use of any type pivotal connection means. FIG. 3 illustrates just one type of connection means to be utilized. The collapsible stool is further comprised of a seating surface, i.e., cloth, wood, etc., attached to the plurality of connecting struts 14. The seating surface is preferred that it be cloth so that it can fold up with the collapsible stool and inserted in the tube, however it may be a wooden surface which can be taken off the connecting struts and held separately from the other members of the collapsible stool.

Optionally, for stability, the collapsible stool may be further comprised of a plurality of radial connecting struts 17 radially and pivotally connected at one end to the first cap 4 and pivotally connected at the other end to the second ends of the support struts.

The tube inside diameter and length are of sufficient size to enclose the plurality of leg support, support struts and connecting struts.

For stability it is preferred that there be four support struts, four connecting struts and four leg supports. One skilled in the art, can realize however that three leg supports, three connecting struts and three support struts may be utilized in this invention. It is further contemplated that any number of support struts, connecting struts and leg supports may be utilized.

In use one would carry around with him the tube 1 with both caps attached to each end of the tube. Inside of the tube would be the support struts, leg supports and connecting struts and optionally the seating surface. When one desires to use the collapsible stool one unscrews the top cap, takes out the leg supports, connecting struts and support struts. The leg struts are screwably mounted (in the preferred embodiment) into the second cap. The support struts and the connecting struts are spread out and the support struts inserted in the mounting means connected to the tube. This action will enfold the seat which can be sat upon. The first screw cap can be screwed on to the first end of the tube so that it will not be lost.

When the device has a plurality of radial connecting struts attached to the first cap one unfolds the radial connecting struts, connecting struts and support struts, screws the first cap onto the tube and then attaches the support struts to the mounting means.

While it will be apparent that the illustrated embodiments of my invention herein shown are well calculated to adequately fulfill the objects and advantages primarily stated, it is to be understood that the invention is susceptible to variation, modification and change within the scope of the sub-joined claims.

What I claim as new is:

1. A collapsible stool comprising:

a. a tube having a first end and a second end;

b. a first cap detachably mounted to the first end of the tube;

c. a second cap detachably mounted to the second end of the tube;

d. a plurality of leg supports radially and detachably mounted to the second cap;

e. A plurality of support struts having first ends extending radially from the tube and extending above the first end of the tube, detachably mounted at the first ends to the tube between the first end of the tube and the second end of the tube;

f. a plurality of mounting means attached to the tube between the first end of the tube and the second end of the tube for detachably mounting the first ends of the support struts to the tube;

g. a plurality of connecting struts pivotally connected to the second ends of the support struts wherein a plane surface is formed; and h. a plurality of radial connecting struts radially and pivotally mounted at one end to the first cap and pivotally connected at the second end of the support struts;

i. a seating surface attached to the plurality of connecting struts;

wherein the tube has an inside diameter and a length of sufficient size to enclose the plurality of leg supports, support struts, connecting struts and radial connecting struts and when the first cap is unmounted from the first end the support struts, connecting struts and radial connecting struts pivot below the first cap so that when the first cap is remounted on the first end, the support struts, connecting struts and radial connecting struts can be inserted in the tube.

2. The collapsible stool of claim 1, wherein the caps are screwably mounted to the tube ends.

3. The collapsible stool of claim 1, wherein the leg supports are screwably mounted to the second cap.

4. The collapsible stool of claim 1, wherein the plurality of mounting means are comprised of slots in the tube and catch means attached to the first ends of the support struts for attaching the support struts to the slots.

5. The collapsible stool of claim 1, wherein there are four support struts, four connecting struts, and four leg supports.

* * * * *